United States Patent [19]

Lofgren

[11] 4,335,655

[45] Jun. 22, 1982

[54] METHOD AND APPARATUS FOR DETONATING EXPLOSIVE IN RESPONSE TO DETONATION OF REMOTE EXPLOSIVE

[75] Inventor: Letcher A. Lofgren, Glenwood, Md.

[73] Assignee: United States of America as represented by the Secretary of the Army, Washington, D.C.

[21] Appl. No.: 133,735

[22] Filed: Mar. 25, 1980

[51] Int. Cl.[3] ..... F42C 11/04

[52] U.S. Cl. ..... 102/209; 102/505

[58] Field of Search ..... 102/209, 505

[56] References Cited

U.S. PATENT DOCUMENTS

| | | | |
|---|---|---|---|
| 2,889,776 | 6/1959 | Gunther | 102/209 |
| 3,143,965 | 8/1964 | LaPointe | 102/505 |
| 3,677,182 | 7/1972 | Peterson | 102/505 |
| 3,765,336 | 10/1973 | Kulsik | 102/505 |

FOREIGN PATENT DOCUMENTS

| | | | |
|---|---|---|---|
| 7629600 | 1/1976 | France | 102/209 |

*Primary Examiner*—Charles T. Jordan

*Attorney, Agent, or Firm*—Nathan Edelberg; Robert P. Gibson; Saul Elbaum

[57] ABSTRACT

A method and apparatus for detonating an explosive in response to the detonation of a remote explosive without damaging any components positioned intermediate the two explosives. A permanent magnet having a coil of wire positioned thereabout is positioned adjacent to one of the explosives, and the output from the coil is connected to the detonator for the second explosive. When the first explosive is detonated, the permanent magnet is destroyed to thereby collapse the magnetic field traversing the coil. The collapse of the magnetic field generates a voltage which is transmitted to the detonator for the second explosive for initiating detonation of same. The preferred embodiment positions the coil and magnet adjacent to an electronic time fuze detonator and lead charge at the forward end of a cargo-carrying projectile, whereas the second explosive is positioned at the rear of the projectile for initiating ejection of a payload.

7 Claims, 4 Drawing Figures

FIG. 1
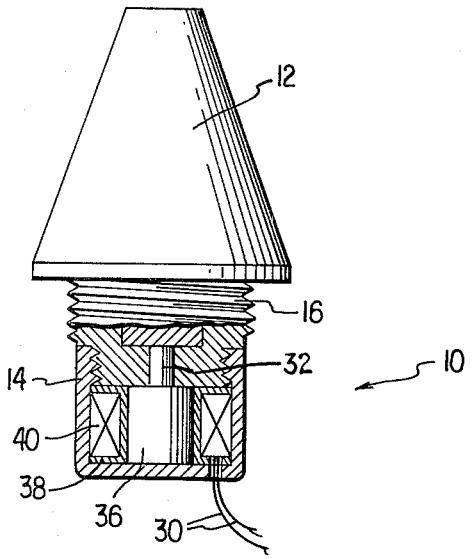
FIG. 2
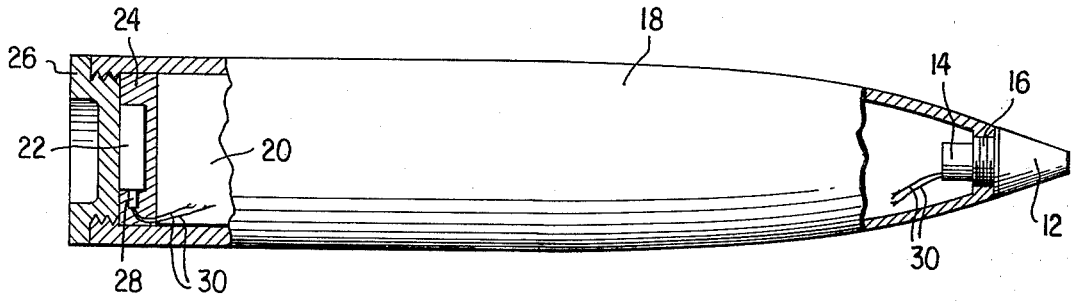
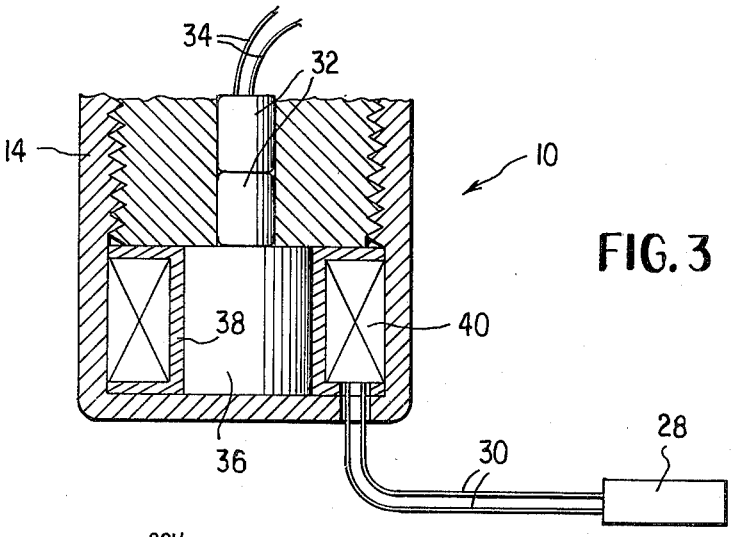
FIG. 3
FIG. 4
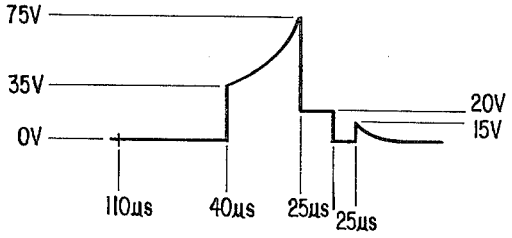

METHOD AND APPARATUS FOR DETONATING EXPLOSIVE IN RESPONSE TO DETONATION OF REMOTE EXPLOSIVE

RIGHTS OF THE GOVERNMENT

The invention described herein may be manufactured, used and licensed by or for the United States Government for governmental purposes without the payment to me of any royalty thereon.

BACKGROUND OF THE INVENTION

1. Field of the Invention

The present invention is related to projectiles and, more particularly, is directed toward a technique and device which permits an explosive charge located in one portion of a projectile to be detonated in response to detonation of an explosive charge positioned in another portion of the projectile.

2. Description of the Prior Art

There exists in the family of military projectiles a cargo round which is designed to carry various payloads and eject them during flight. Such cargo may comprise, for example, radio jamming devices, and it is generally desired to eject such devices from the projectile at a predetermined point in time after the projectile has been launched. Cargo is normally ejected from the rear or base of the projectile by detonating an explosive charge which acts to remove a base plug from the projectile permitting the cargo to be ejected.

Detonation of the charge in the base of the projectile may be initiated by an electronic time fuze positioned at the forward portion of the projectile. Such a time fuze is preset to detonate its own explosive at a predetermined period of time after the projectile is launched. A problem exists in effectively translating the explosive charge of the time fuze into an electrical signal which may be utilized to detonate the explosive at the rear of the projectile.

A high explosive detonating cord known as Primacord has been used in the past to transmit a detonation from one point to another at the other end of the cord. Such a device, however, is unsuitable for the application discussed above, since the cord itself is detonated and anything along the path of the cord stands to be damaged or destroyed. Thus, the payload in the cargo projectile between the fuze and the rear base plug would be subjected to damage or destruction.

A need, therefore, arose to provide such a cargo-carrying projectile with a means for utilizing the explosive charge at the front end of the projectile to detonate the charge at the rear end of the projectile, without destroying the payload positioned between the charges. It is toward fulfilling this need that the present invention is advanced.

OBJECTS AND SUMMARY OF THE INVENTION

It is therefore a primary object of the present invention to provide a method and apparatus for detonating one explosive in response to the detonation of a remotely located explosive without destroying anything positioned between the two explosives.

Another object of the present invention is to provide an apparatus which responds to an explosive charge for generating a voltage sufficient to detonate a remotely located detonator.

A further object of the present invention is to provide a passive device for detonating a remotely located explosive in response to detonation of a first explosive which is simple and inexpensive to fabricate, highly reliable in operation and is insensitive to setback forces to which the device may be subjected during launch.

The foregoing and other objects are attained in accordance with one aspect of the present invention through the provision of an apparatus which comprises electromagnetic induction means responsive to the detonation of a first explosive positioned at the forward end of a projectile for generating a voltage signal, and means for transmitting the voltage signal to means for detonating a second explosive positioned at the rear end thereof.

The electromagnetic induction means more particularly comprises a magnet and a coil of wire positioned in proximity to the magnet so as to be traversed by the magnetic field thereof. The magnet is preferably positioned adjacent the first explosive and is pulverized in response to the detonation of the first explosive so that the magnetic field through the coil of wire is caused to collapse thereby generating the signal. In a preferred form, the magnet comprises a substantially cylindrical permanent magnet and the coil of wire is wrapped about the periphery of the magnet. Means are preferably positioned between the periphery of the magnet and the coil of wire for holding the coil of wire in place in the fuze. The means for transmitting the voltage signal comprises electrical wires connected between the coil of wire and the means for detonating the second explosive.

In accordance with another aspect of the present invention, there is provided a method of detonating a first explosive charge positioned remotely from and in response to a second explosive charge without damaging components positioned between the first and second charges, comprising the steps of positioning a permanent magnet in proximity to the second explosive charge, wrapping a coil of wire in proximity to the magnet so that the coil is traversed by the magnetic field of the magnet, connecting electrical wire between the coil and means for detonating the first explosive charge and detonating the second explosive charge to cause the magnetic field to collapse and thereby generate a voltage in the electrical wire. The step of detonating the second explosive charge includes the step of destroying the magnet and thereby collapsing the magnetic field thereof.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a side view, partly in section, illustrating a time fuze having a preferred embodiment of the present invention incorporated therein;

FIG. 2 is a side view, partly in section, which shows the preferred embodiment of the present invention mounted in a cargo-carrying projectile;

FIG. 3 is an enlarged, cross-sectional view of the preferred embodiment of the present invention; and FIG. 4 is a graph which illustrates a typical voltage signal obtained from the apparatus illustrated in FIG. 3.

DETAILED DESCRIPTION OF THE PREFERRED EMBODIMENT

Referring now to the drawings, wherein like reference numerals represent identical or corresponding parts throughout the several views, and more particularly to FIGS. 1 and 2 thereof, the preferred embodiment of the present invention is indicated generally by reference numeral 10.

The device 10 of the present invention is shown positioned in the rearward portion of an electronic or mechanical time fuze 12 which includes a rearwardly extending fuze housing or body 14 having threads 16 for securing same to the forward portion of a cargo-carrying projectile 18.

The projectile 18 with which the present invention is particularly designed to be utilized includes one or a plurality of cargo packages or payloads 20 which may comprise, for example, radio jamming devices. The payload 20 is desired to be ejected from the projectile 18 a predetermined time after the projectile is launched. To accomplish ejection, the rear portion of the projectile 18 is provided with an ejector charge 22 which is detonated by means of an electric detonator 28 positioned adjacent thereto. A base plug ejector 24 comprises a plate which is designed to eject the base plug 26 from the rear of the projectile 18 upon detonation of charge 22. As is conventional, the cargo package 20 may be provided with its own propulsive charge to eject it from the body of projectile 18 after the base plug 26 has been blown away. The details of construction of projectile 18 and its associated base plug and ejector means are well-known to a person of ordinary skill in this art, and therefore need not be described in greater detail than heretofore given.

In FIG. 2 is illustrated electrical lead wires 30 which are connected between the present invention 10 and the rear detonator 28, for a purpose which will become clearer hereinafter.

Referring now to FIG. 3, a vertical cross-section of the fuze housing 14 is illustrated. As is conventional, the fuze 12 is provided with an explosive train 32 in the central portion thereof which responds to an electrical signal along wires 34 for detonating same. The signal on wires 34 may be provided by any conventional electronic or mechanical timing means, well-known to a person of ordinary skill in this art. The explosive train 32 consists of, for example, a detonator, lead and booster charge.

Positioned adjacent and rearwardly of the explosive train 32 of the fuze 12 is a substantially cylindrical permanent magnet 36. The dimensions of the magnet 36 may be, for example, 1 inch in diameter and $\frac{5}{8}$ inch long. Positioned about the outer periphery of magnet 36 is a cylindrical spool 38 which is securely mounted to fuze housing 14. Wrapped about the periphery of spool 38 are a plurality of turns of wire 40 which form a coil. The coil 40 may be formed of, for example, 160 turns of No. 26 magnet wire, and is positioned with respect to magnet 36 so that the magnetic field from the latter traverses the coil 40.

Shown extending from the coil 40 are electrical leads 30 that terminate in the electric detonator 28 positioned at the rear of the projectile 18, or in any other remote location.

In operation, when the explosive charge 32 is detonated by action of the time fuze, the explosion smashes or destroys the magnet 36. This action causes the magnetic field previously established in coil 40 to collapse. The collapse of the magnetic field, in turn, generates a substantial voltage pulse in coil 40 which is transmitted via wires 30 to the electric detonator to initiate detonation of same.

A typical voltage pulse generated by the present invention is shown in FIG. 4. Such a voltage pulse is transmitted to the rear of the projectile 18, or to any other remote location, without damaging any components between the two explosive charges. It may be appreciated that the present invention may be characterized as a solid state inert device which can be stored indefinitely and which is capable of providing an electric impulse to initiate an action remotely located from the initial explosion. The device is passive, not sensitive to setback forces, and is simple and inexpensive to fabricate.

Obviously, numerous modifications and variations of the present invention are possible in light of the above teachings. It is therefore to be understood that within the scope of the appended claims, the invention may be practiced otherwise than as specifically described herein.

I claim:

1. An apparatus for releasing a payload from a projectile comprising:

a means for securing said payload positioned on the rear of said projectile;

a first explosive charge positioned at the forward end of said projectile;

a fuze for detonating said first explosive charge;

electromagnetic induction means positioned adjacent to said first explosive charge;

a second explosive charge positioned adjacent said means for securing;

means for detonating said second explosive charge in response to the detonation of said first explosive charge whereby said payload is released.

2. The apparatus as set forth in claim 1, wherein said electromagnetic induction means comprises a magnet and a coil of wire positioned in proximity to said magnet so as to be traversed by the magnetic field of said magnet.

3. The apparatus as set forth in claim 2, wherein said magnet is positioned adjacent said first explosive and is destroyed in response to the detonation of said first explosive whereby said magnetic field through said coil of wire is caused to collapse.

4. The apparatus of claim 3, wherein said magnet comprises a substantially cylindrical permanent magnet and said coil of wire is wrapped about the periphery of said magnet.

5. The apparatus of claim 4, further comprising spool means positioned between said periphery of said magnet and said coil of wire for holding said coil of wire in place in said fuze.

6. A method of detonating a first explosive charge positioned remotely from and in response to a second explosive charge without damaging components positioned between said first and second charges, comprising the steps of:

positioning a permanent magnet in proximity to said second explosive charge;

wrapping a coil of wire in proximity to said magnet so that said coil is traversed by the magnetic field of said magnet;

connecting electrical wire between said coil and means for detonating said first explosive charge; and detonating said second explosive charge to cause said magnetic field to collapse and thereby generate a voltage in said electrical wire to detonate said first explosive charge.

7. The method of claim 6, wherein said step of detonating said second explosive charge includes the step of destroying said magnet and thereby collapsing said magnetic field.

* * * * *